US006241544B1

(12) United States Patent
Fukumoto et al.

(10) Patent No.: US 6,241,544 B1
(45) Date of Patent: Jun. 5, 2001

(54) CONNECTOR

(75) Inventors: Yutaka Fukumoto; Hideo Miyazawa; Takeshi Okuyama, all of Tokyo (JP)

(73) Assignee: Fujitsu Takamisawa Component Limited, Tokyo (JP)

( * ) Notice: Subject to any disclaimer, the term of this patent is extended or adjusted under 35 U.S.C. 154(b) by 0 days.

(21) Appl. No.: 09/328,370

(22) Filed: Jun. 9, 1999

(30) Foreign Application Priority Data

Jun. 9, 1998 (JP) ..... 10-160643
Apr. 5, 1999 (JP) ..... 11-098137

(51) Int. Cl.[7] ..... H01R 13/15
(52) U.S. Cl. ..... 439/264; 439/263; 439/266
(58) Field of Search ..... 439/263, 264, 439/265, 266, 268, 269, 270, 682, 686, 377

(56) References Cited

U.S. PATENT DOCUMENTS 4,373,764 * 2/1983 Ulrich ..... 339/75
4,815,987 * 3/1989 Kawano et al. ..... 439/263
4,927,372 * 5/1990 Collier ..... 439/83
5,797,768 * 8/1998 Francaviglia ..... 439/567

* cited by examiner

*Primary Examiner*—Gary F. Paumen
*Assistant Examiner*—Alexander Gilman
(74) *Attorney, Agent, or Firm*—Staas & Halsey LLP

(57) ABSTRACT

The present invention provides a connector that can adjust the strength of the connection between the pins of a plug and the contacts of a jack by converting the horizontal motion of a member integrated into the jack or the plug into the vertical motion of an actuator disposed so as to adjust the strength of the contact between the pins and the contacts, thereby eliminating the need for a connector tool to accomplish the adjustment and thus both reducing the load surface area of the connector and eliminating the need for space in which to insert and remove plugs.

16 Claims, 19 Drawing Sheets

PRIOR ART

PRIOR ART

PRIOR ART

CONNECTOR

BACKGROUND OF THE INVENTION

1. Field of the Invention

The present invention relates generally to an low-insertion-force (hereinafter LIF) connector having an actuator for adjusting the strength of the connection between the contacts of a jack and the pins of a plug.

2. Description of the Related Art

In recent years, with the increasing density of substrate circuitry and the greater number of signal lines required by an increasing array of functions, the number of pins on the connectors of the substrates of communications devices, personal computers, workstations, large-scale calculators and the like has also increased. As a result, connectors into which multi-pin jacks and plugs are inserted require substantial force both to insert and to remove the jacks and plugs inserted therein. In such a situation, an LIF connector capable of opening or closing the connectors as appropriate and permitting the insertion and removal of even a multi-pin plug with a minimum amount of force is used.

FIG. 1 is a diagram of the structure of a conventional LIF connector. It should be noted that FIG. 1 depicts only the jack portion of the connector.

The conventional LIF connector jack portion 101 comprises, for example, a jack base 102 in a state in which pins 106 for connection to the substrate are mounted on a bottom part and contacts 105 for inserting the pins of the plug portion are mounted on a top part, an actuator 103 for adjusting the strength of the connection between the pins of the plug and the contacts 105 by being moved up or down with respect to the base, and a jack cover 104 made of an insulating material for the purpose of preventing trouble such as a short circuiting caused by contact from external parts.

FIGS. 2(A), 2(B) and 2(C) show external top, front and side views, respectively, of the-jack portion 101 in a state of being mounted on a substrate 111. Normally, pins 106 for connection to the substrate are mounted and, as shown in the diagram, the pins 106 are inserted into through-holes in the substrate and soldered. Additionally, a slanted slot 112 is formed in the actuator and is used when adjusting the strength of the connection of the pins of the plug with the contacts 105.

FIGS. 3(A) and 3(B) show top and side views, respectively, of a state in which an LIF connector tool is further mounted on the LIF connector depicted in FIG. 2. As shown in the diagram, the LIF connector tool comprises an operating member 121, an engaging portion 122 and a slide cam 123, with the slide cam 123 positioned so as to sandwich the jack portion 101.

FIGS. 4(A) and 4(B) show how the actuator 103 is moved by the LIF connector tool depicted in FIG. 3. Initially, a projection 124 provided on a side surface of the slide cam 123 facing the jack 101 is accommodated at a predetermined initial position of a slot 112 in the actuator 103, as shown in FIG. 4(A). Additionally, when the projection 124 is at that initial position, as shown in FIG. 3(A) and also in FIG. 4(A), the operating member 121 is perpendicular to the plane of the slide cam 123, the actuator 103 is positioned at a maximum low position and the contacts 105 of the jack portion 101 are opened. At this stage the strength of connection at the contacts 105 is at its weakest.

It is in such a state that by gradually depressing the operating member 121 toward the jack portion 101 that the teeth of the gears of the engaging portion 122 mesh, gradually drawing the slide cam 123 toward the engaging portion 122. At the same time, the projection 124 of the slide cam 123 accommodated within the slot 112 moves gradually in the direction indicated by the arrow shown in FIG. 4(A), that is, in a horizontal direction. As noted previously the slot 112 is slanted, so the actuator 103 is gradually lifted upward.

By depressing the operating member 121 so that it is in contact with the substrate 111 the projection 124 moves to the position shown in FIG. 4(B), thus positioning the actuator 103 at a maximum high position and closing the contacts 105 of the jack portion 101. At this stage the strength of contact at the contacts 105 is at its greatest.

As thus described the conventional connector, through the use of an LIF connector tool, operates by moving the actuator 103 up and down with respect to the substrate 111 so as to adjust the strength of contact between the contacts 105 of the jack portion 101 and the pins of the plug not shown in the diagram. It should be noted that it is normally not necessary to perpetually mount the LIF connector tool depicted in FIG. 3 on the substrate 111. Instead, it is sufficient to mount the LIF connector tool on the substrate 111 only when inserting or removing the plug pins.

However, conventionally a tool for inserting and removing the plug pins is mounted on the substrate together with the LIF connector jack portion, with the result that the load surface area of the connector increases substantially.

Moreover, even an arrangement whereby the above-described tool is only mounted when inserting and removing the plug pins is unsatisfactory because space must be secured for such insertion and removal and no reduction in load surface area is achieved as a result.

SUMMARY OF THE INVENTION

Accordingly, it is an object of the present invention to provide a connector in which the problems described above are solved.

Specifically, it is an object of the present invention to provide an LIF connector that is capable of adjusting the strength of contact by moving the actuator up and down by using a member integrated into a single unit with either the jack or the plug and that, further, makes it possible to reduce the surface load area on the substrate and which does not require space for the insertion and removal of plug pins.

Another object of the present invention is to provide an LIF connector that is capable of adjusting the strength of contact by moving the actuator up and down by using a member integrated into a single unit with either the jack or the plug and that, further, requires minimal force to slide the integrated member in a horizontal direction when adjusting the strength of contact.

The above-described objects of the present invention are achieved by providing a connector comprising:

an actuator for adjusting the strength of contact between contacts of a jack and pins of a plug, the actuator moving vertically within the jack; and an integrated member integrated into a single unit with the jack, the integrated member moving horizontally, wherein by converting the horizontal movement of the integrated member into the vertical movement of the actuator the strength of contact between the contacts of the jack and the pins of the plug is adjusted.

By providing a member integrated into the jack, that is, by integrating the slide cam and the jack in a single unit, it is possible to provide an LIF connector that does not require a tool adjusting the strength of the connection between the pins and the connectors. As a result, the load surface area of the substrate can be greatly reduced and the need for space for inserting and removing the pins of the plug can be eliminated.

Further, the above-described objects of the present invention are also achieved by providing the connector as described above, wherein the projections are disposed at a uniform pitch and the slots are disposed at a pitch gradually greater than that of the projections, such that by sliding the integrated member horizontally the horizontal movement of the integrated member is converted into the vertical movement of the actuator at a gradually increasing time differential.

By providing a connector as described above, wherein the projections are disposed at a uniform pitch while the slots are disposed at a gradually increasingly different pitch from that of the projections, and hence converting the horizontal movement of the integrated member into the vertical movement of the actuator at an increasing time differential, it is possible to temporally disperse the force that would otherwise be required to move vertically a plurality of linked actuators, so that a lesser degree of force is required to operate the integrated member.

Additionally, the above-described objects of the present invention are also achieved by providing a connector comprising:

an actuator for adjusting the strength of contact between contacts of a jack and pins of a plug, the actuator moving vertically within the jack; and an integrated member integrated into a single unit with the plug, the integrated member moving horizontally, wherein by converting the horizontal movement of the integrated member into the vertical movement of the actuator the strength of contact between the contacts of the jack and the pins of the plug is adjusted.

By providing the connector described above, sliding the integrated member horizontally with respect to the substrate eliminates the need for the conventional tool. As a result, the load surface area of the substrate can be greatly reduced and the need for space for inserting and removing the pins of the plug can be eliminated. Additionally, as compared to that which is integrated with the jack, the above-described member has the advantage of permitting the jack cover to be made lighter, thus making it possible to reduce raw material costs.

Further, the above-described objects of the present invention are also achieved by providing a connector as described above, wherein the projections are disposed at a uniform pitch and the slots are disposed at a pitch gradually greater than that of the projections, such that by sliding the integrated member horizontally the horizontal movement of the integrated member is converted into the vertical movement of the actuator at a gradually increasing time differential.

Other objects, features and advantages of the present invention will become more apparent from the following detailed description when read in conjunction with the accompanying drawings.

DESCRIPTION OF THE PREFERRED EMBODIMENTS

A detailed description will now be given with reference to the diagrams of embodiments of an LIF connector according to the present invention, which has as its object to provide a connector that uses the vertical motion of an actuator to adjust the strength of cohesion between the contacts of a jack and the pins of a plug and, further, makes possible a reduction in load surface area of the substrate and does not require space for insertion and removal of the pins.

Figure 5:
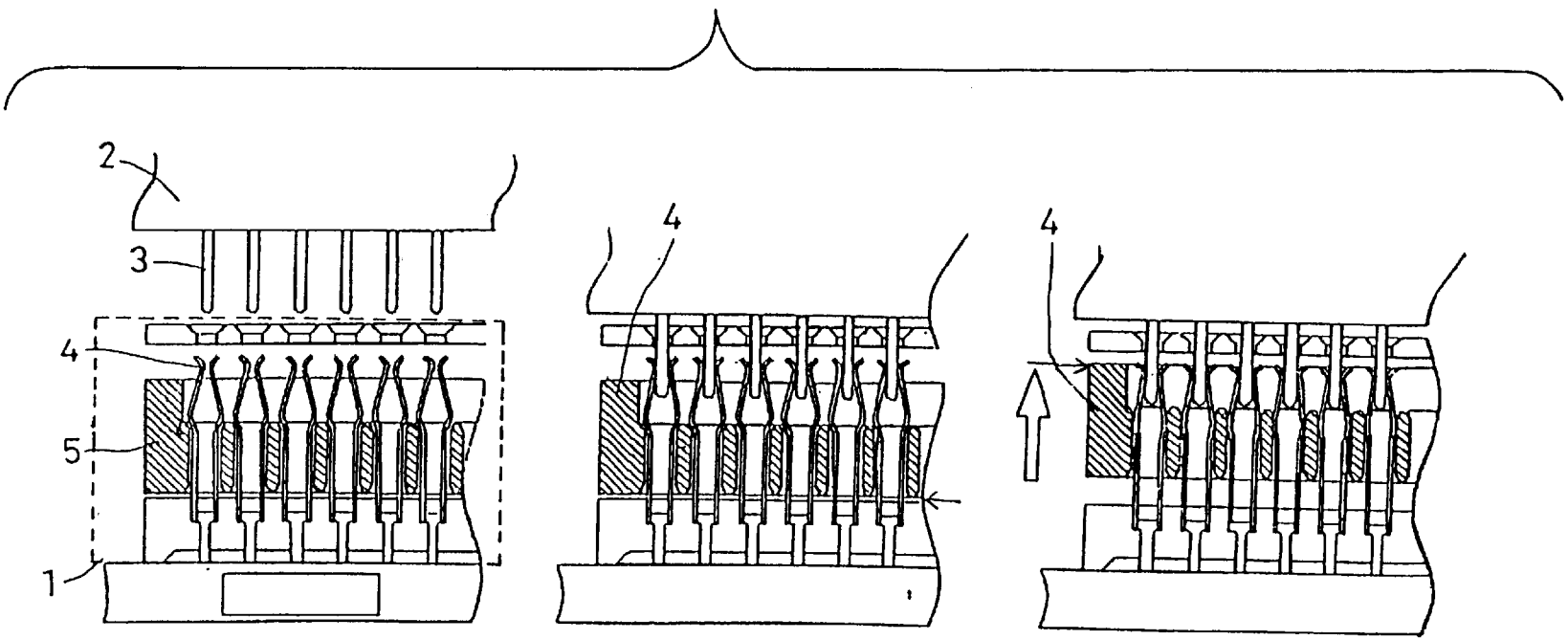
FIG. 5 is a diagram of the LIF connector structure.

FIG. 5 shows the basic structure of an LIF connector. The description will proceed with reference to this basic structure, with the pins 3 of a plug 2 to be inserted into the contacts 4 of a jack mounted on a substrate as shown in (a) of FIG. 5. It should be noted that the jack 1 is equipped internally with an actuator 5 capable of movement up and down.

Initially, as shown in (b) of FIG. 5, the pins 3 of the plug 2 are inserted into the contacts 4 of the jack 1. At this stage, the actuator 5 is at a maximum low position and the contacts 4 are in an open state, and the strength of connection at the contacts 105 is at its weakest.

Next, with the pins 3 of the plug 2 inserted into the contacts 4 of the jack 1 the actuator 5 is gradually moved upward with respect to the base so that the actuator 5 is ultimately positioned at a maximum high position as shown in (c) of FIG. 5. At this stage the contacts 4 are in a closed state and the strength of connection at the contacts 105 is at its greatest.

The LIF connector as described above makes it possible to adjust the strength of the connection between the pins 3 of the plug 2 and the contacts 4 of the jack 1 by the up and down movement of the actuator, so it is possible to insert and remove even a multi-pin connector using only a minimum amount of force.

Figure 6A:
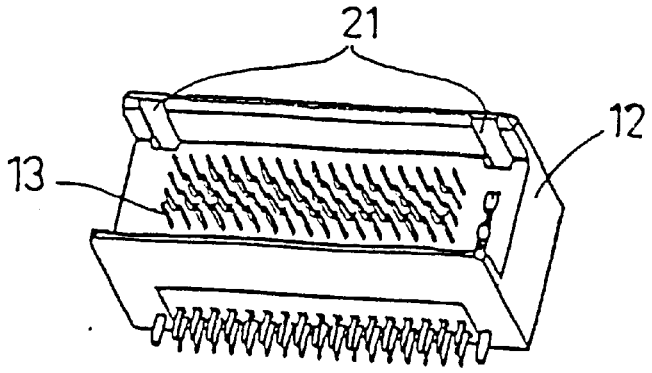
FIG. 6(A) shows an external view of the plug of the present embodiment.
Figure 6B:
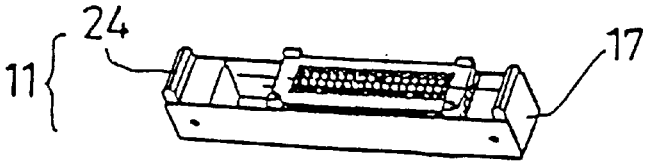
FIG. 6(B) shows an external view of the jack of the present embodiment and FIG. 6(C) shows the jack in a state in which the slide cam is removed.
Figure 6C:
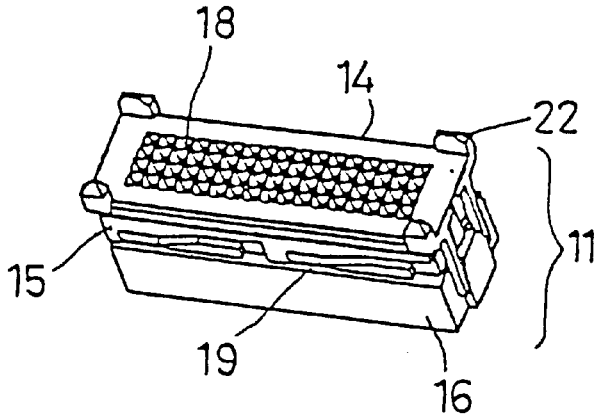
Figure 7:
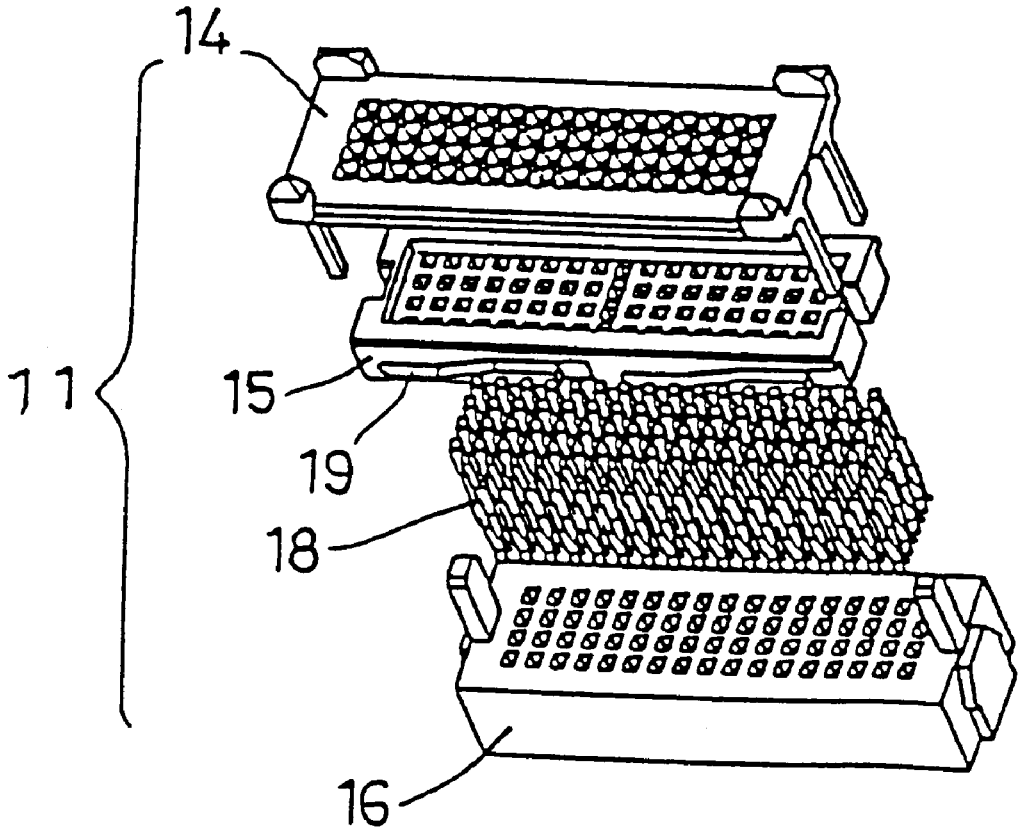
FIG. 7 is a diagram showing the structure of the jack of the first embodiment of the present invention, with the slide cam removed.

FIGS. 6 and 7 show a first embodiment of an LIF connector having a structure according to the present invention. FIG. 6(A) shows an external view of the plug of the present embodiment, FIG. 6(B) shows an external view of the jack of the present embodiment and FIG. 6(C) shows the jack in a state in which the slide cam is removed. FIG. 7 is a diagram showing the structure of the jack of the first embodiment of the present invention, with the slide cam removed.

The connector of the present embodiment is a type of connector in which the pins 13 of the plug 12 are inserted into the contacts 18 of the jack 11. The connector of the present embodiment comprises a jack 11, a jack base 16 for mounting contacts 18, an actuator 15 that is moved up and down so as to adjust the strength of the connection between contacts 18 and the pins 13 on the plug 12, a jack cover 14 that prevents trouble such as short-circuiting caused by contact from external parts and which further functions as a guide when moving the actuator 15 up and down, and a slide cam 17 for moving the actuator 15 up and down. This structure thus combines the conventional jack with the slide cam 17.

The above-described LIF connector of the present embodiment converts the horizontal motion of the slide cam 17 into the vertical motion of the actuator 15 so as to adjust the strength of the connection between the contacts 18 of the jack 11 and the pins 13 of the plug 12.

FIG. 8 depicts in detail the operation of the first embodiment of the present invention. It should be noted that the jack 11 of the present embodiment is mounted so as to engage the slots 19 formed on both side surfaces of the actuator with the projections 23 formed on the slide cam 17.

Figure 8B:
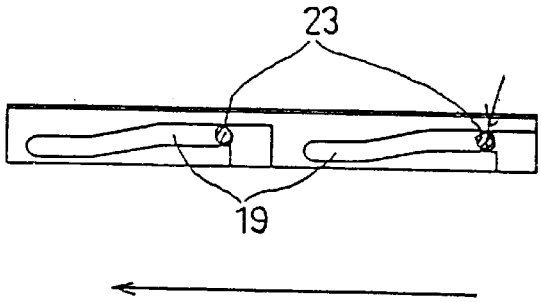
FIG. 8(A), FIG. 8(B), FIG. 8(C) and FIG. 8(D) show the operation of the present embodiment, specifically a strength of connection in its weakest state, the position of a projection in that weakest state, the position of the projection with the strength of connection in its strongest state, and the strength of connection in that strongest state, respectively.
Figure 8A:
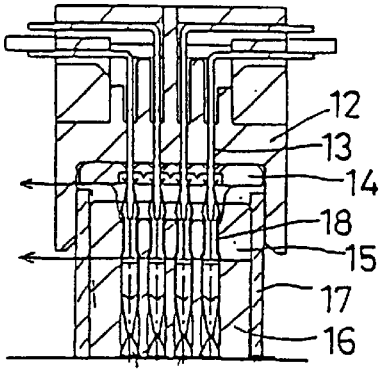

Initially, as shown in FIG. 8(A), the pins 13 of the plug 12 are inserted in the contacts 18 of the jack 11 mounted on the substrate. At this stage, the projections 23 on the slide cam 17 are accommodated at a predetermined initial position in the slot 19 of the actuator 15 as shown in FIG. 8(B). With the projections 23 at this initial position with the slot 19, the actuator 15 is positioned at a maximum low position and the contacts 18 are in an open state, with the strength of connection of the contacts 18 at its weakest.

In such a state, by gradually moving the slide cam 17 to the left, that is, in the direction of the arrow shown in FIG. 8(B), the projections 23 also simultaneously move. The slot 19 is slanted, so as the projections 23 gradually move leftward the actuator 15 is gradually raised upward.

Figure 8C:
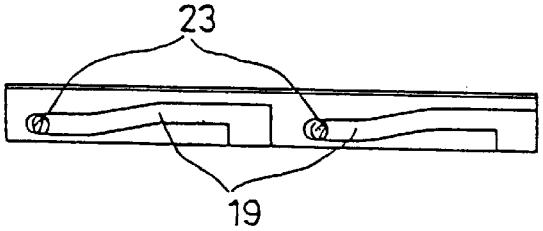
Figure 8D:
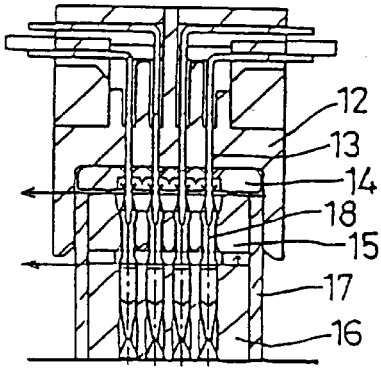

By continuing to move the slide cam 17 leftward such that the projections 23 are positioned as shown in FIG. 8(C), the actuator 15 is positioned at a maximum high position as shown in FIG. 8(D), the contacts 18 are squeezed by the actuator 15 and closed. At this stage the strength of contact of the contacts 18 is at its greatest.

As thus described, by sliding the slide cam 17 horizontally the horizontal motion of the slide cam 17 is converted into the vertical motion of the actuator 15 so as to adjust the strength of connection between the contacts 18 of the jack 11 and the pins 13 of the plug 12.

Additionally, in the present embodiment backslide prevention projections 22 are formed at the engaging portion of the jack 11 and a backslide prevention groove 21 is formed in the engaging portion of the plug 12. As a result, improper pin insertion can be prevented, thus eliminating the possibility of accidents or of damage to electrical components arising therefrom. It should be noted that the positions of the groove 21 and projections 22 may be reversed and that their quantity is arbitrary.

Figure 1:
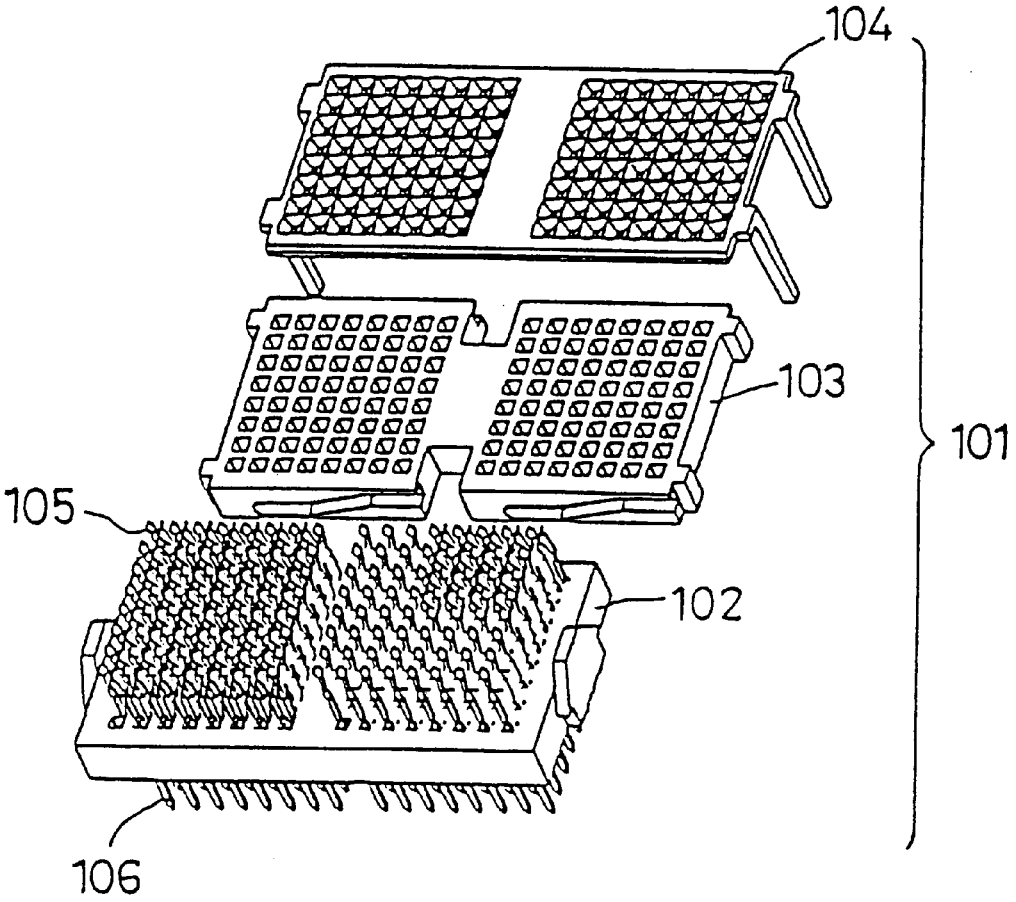
FIG. 1 is a diagram of the structure of a conventional LIF connector.
Figure 2A:
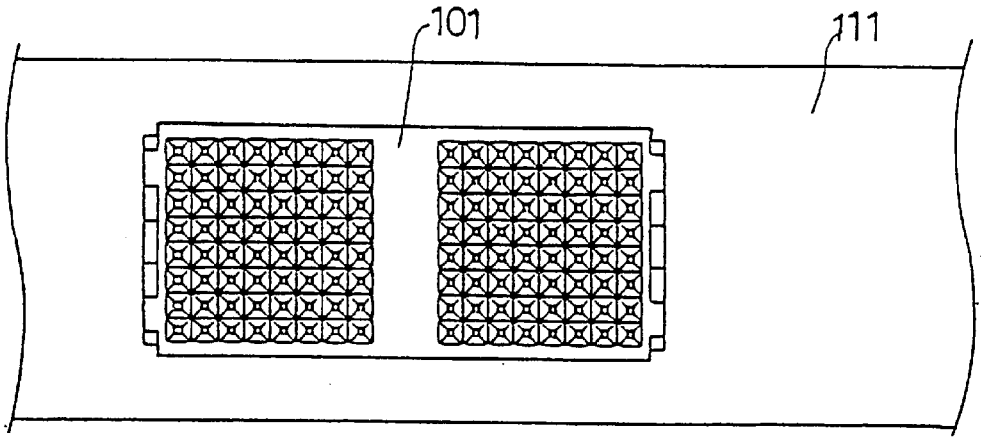
PRIOR ART FIG.2(A)
FIGS. 2(A), 2(B) and 2(C) show external top, front and side views, respectively, of the jack portion 101 in a state of being mounted on a substrate 111.
Figure 2B:
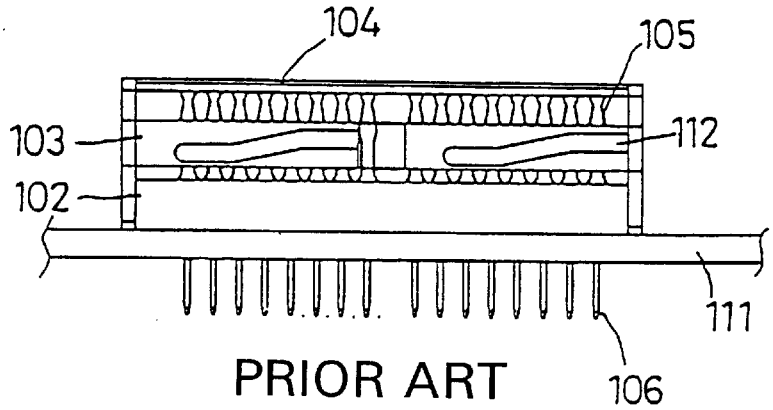
PRIOR ART FIG.2(B)
Figure 2C:
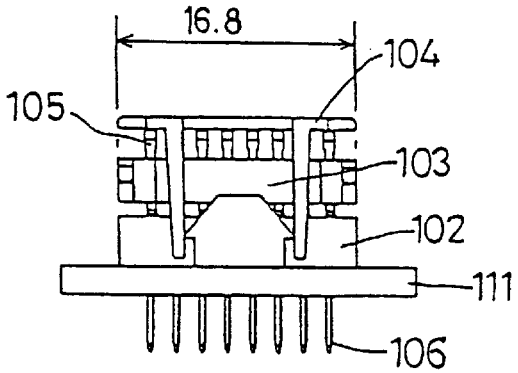
PRIOR ART FIG.2(C)
Figure 3A:
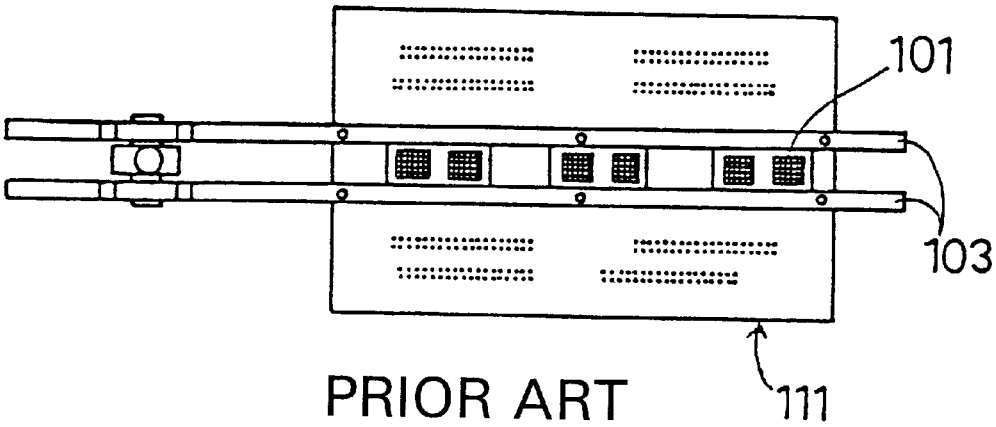
FIGS. 3(A) and 3(B) show top and side views, respectively, of a state in which an LIF connector tool is further mounted on the LIF connector depicted in FIG. 2.
Figure 3B:
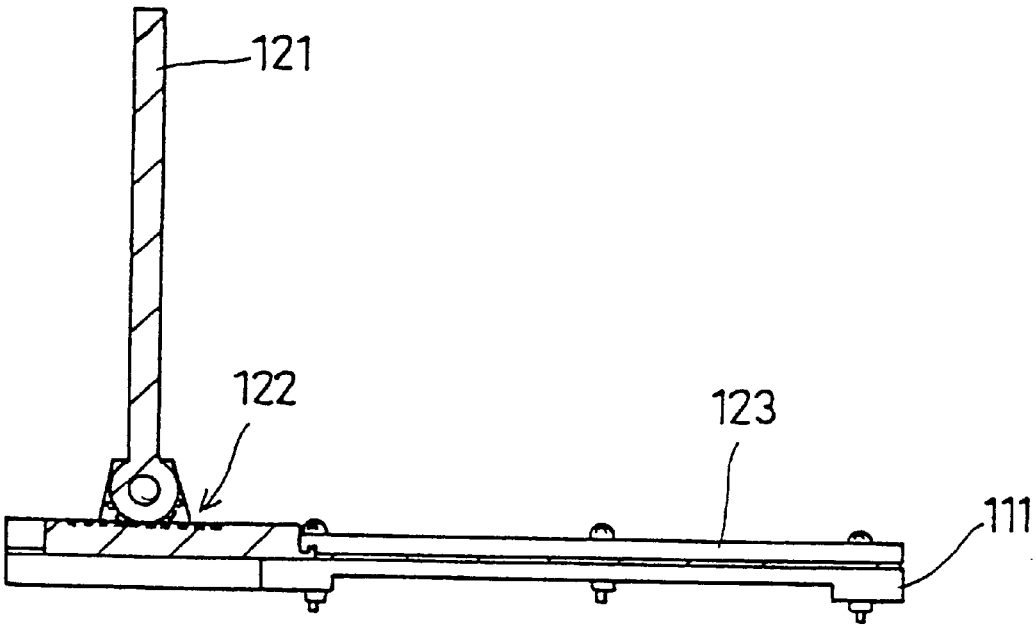
PRIOR ART FIG.3(B)
Figure 4A:
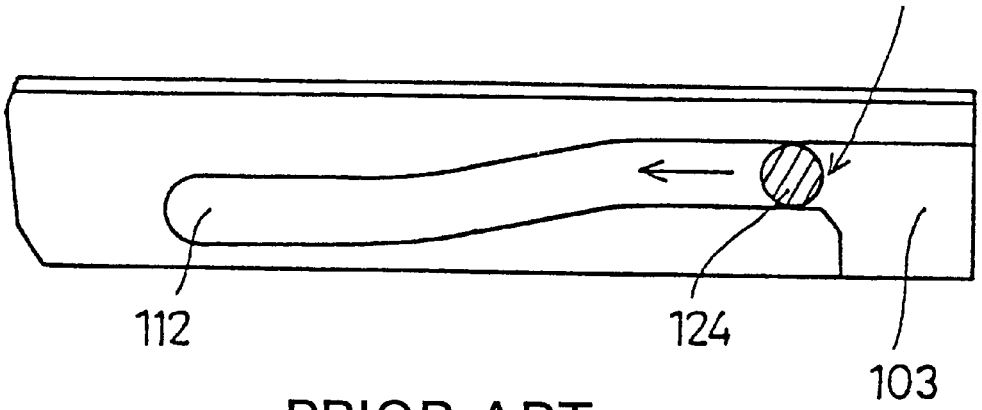
FIGS. 4(A) and 4(B) show how the actuator 103 is moved by the LIF connector tool depicted in FIG. 3.
Figure 4B:
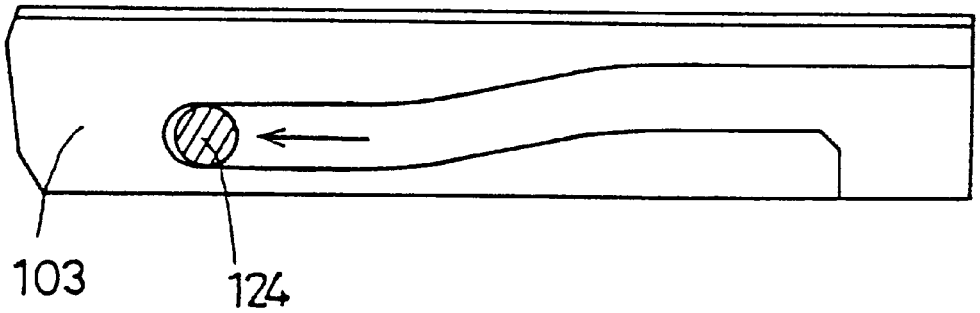
PRIOR ART FIG.4(B)

Additionally, in the present invention the jack 11 may either be mounted on the substrate by inserting the pins 100 into through holes on the substrate as conventionally as shown in FIG. 1 or by providing holes for pin insertion in the bottom of the jack 11 and mounting the jack 11 on the substrate by inserting the pins mounted on the substrate as shown in FIG. 8(A). By using the latter mounting method it is possible to have a solderless substrate connection, thus easing connection to and removal from the substrate and reducing the number of steps in assembly.

According to the first embodiment of the present invention as described above, it is possible to achieve a reduction in the load surface area of the substrate and at the same time eliminate the need for space on the substrate for insertion and removal of the pins from the connectors.

Figure 9A:
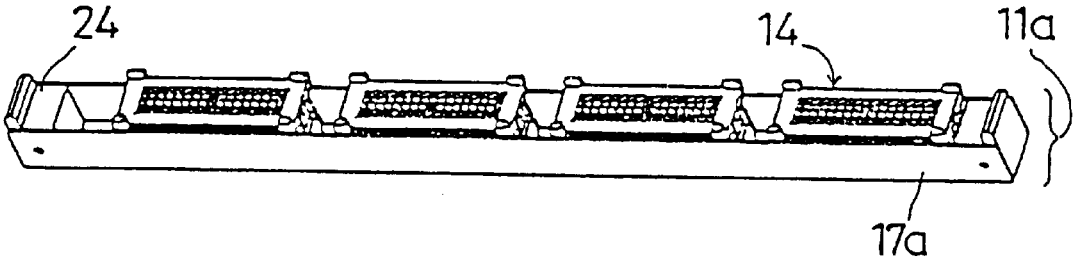
FIG. 9(A) and FIG. 9(B) are an external view of the present embodiment with the plug not yet inserted and an external view of the present embodiment with the plug inserted, respectively.
Figure 9B:
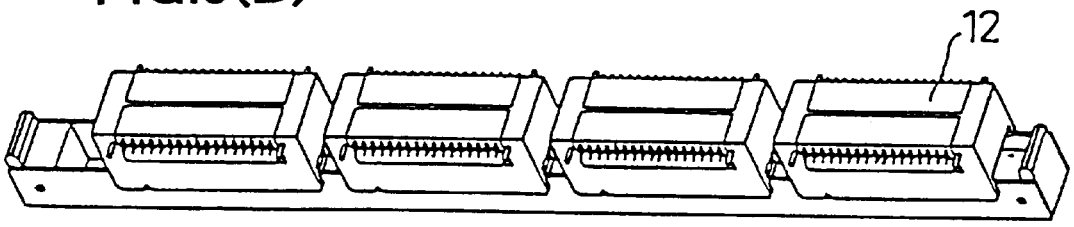

FIG. 9 is a diagram of a second embodiment of the present invention, showing the structure of the LIF connector. FIG. 9(A) is an external view of the present embodiment with the plug not yet inserted and FIG. 9(B) is an external view of the present embodiment with the plug inserted.

The connector of this second embodiment, like that of the first embodiment, is a connector in which the pins 13 of the plug 12 are inserted in the contacts 18. The jack 11*a* of the connector of the present embodiment is integrated into a single unit with the slide cam 17*a* so as to be able to mount a plurality of plugs 12, with the remainder of the structure being identical to that of the first embodiment.

The LIF connector described above simultaneously adjusts the strength of the connection between contacts 18 of the jack 11 and the pins 13 of the plug 12, by converting the horizontal movement of the slide cam 17*a* into the vertical movement of a plurality of actuators 15. That is, in this second embodiment of the present invention the slide cam 17*a* and the plurality of actuators are linked. The operation of this second embodiment is identical to that described with reference to FIG. 8 and a discussion thereof is thus omitted here.

Figure 10:
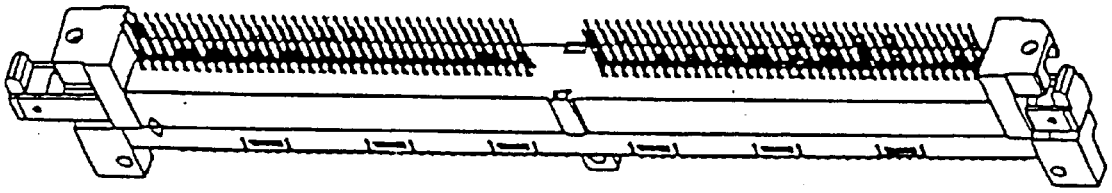
FIG. 10 is an external view of a third embodiment of the present invention.
Figure 11:
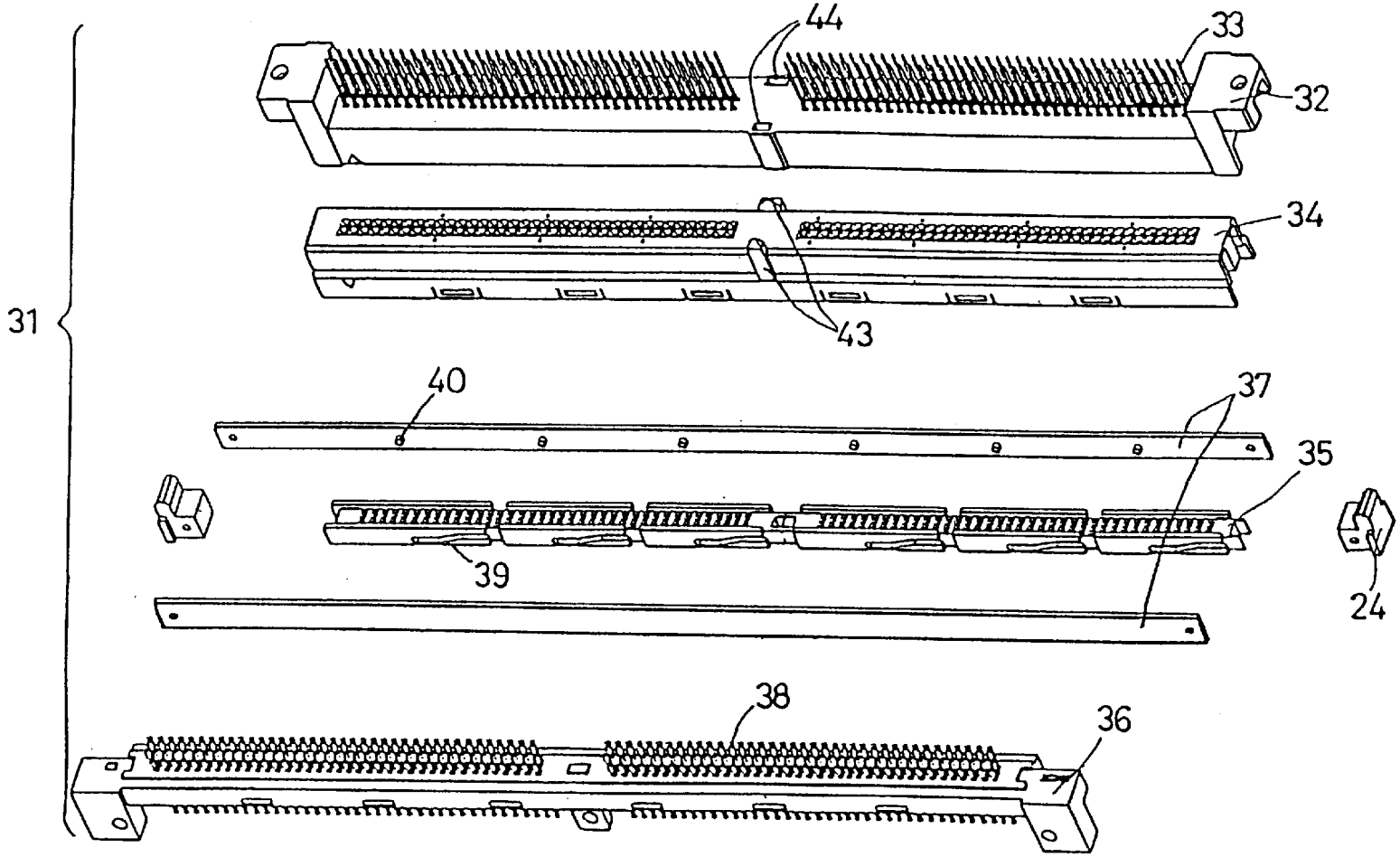
FIG. 11 is a diagram of the structure of the third embodiment of the present invention.

FIG. 10 and FIG. 11 show a third embodiment of the present invention. FIG. 10 is an external view of the embodiment and FIG. 11 shows the structure of the embodiment.

The LIF connector of the present embodiment is a type of connector in which the pins 33 of the plug 32 are inserted in the contacts 38 of the jack 31. Additionally, the jack 31 of the present invention comprises a jack base 36 for mounting the contacts 38, an actuator 35 that is moved up and down so as to adjust the strength of the connection between the contacts 38 and the pins 33 on the plug, 30 a jack cover 34 that prevents trouble such as short-circuiting caused by contact from external parts and which further functions as a guide when moving the actuator 35 up and down, and a slide cam 37 for moving the actuator 35 up and down.

The LIF connector of the present embodiment as described above adjusts the strength of the connection between the pins 33 of the plug 32 and the contacts 38 of the jack 31 by converting the vertical movement of the slide cam 37 into the horizontal movement of the actuator 35.

Figure 12:
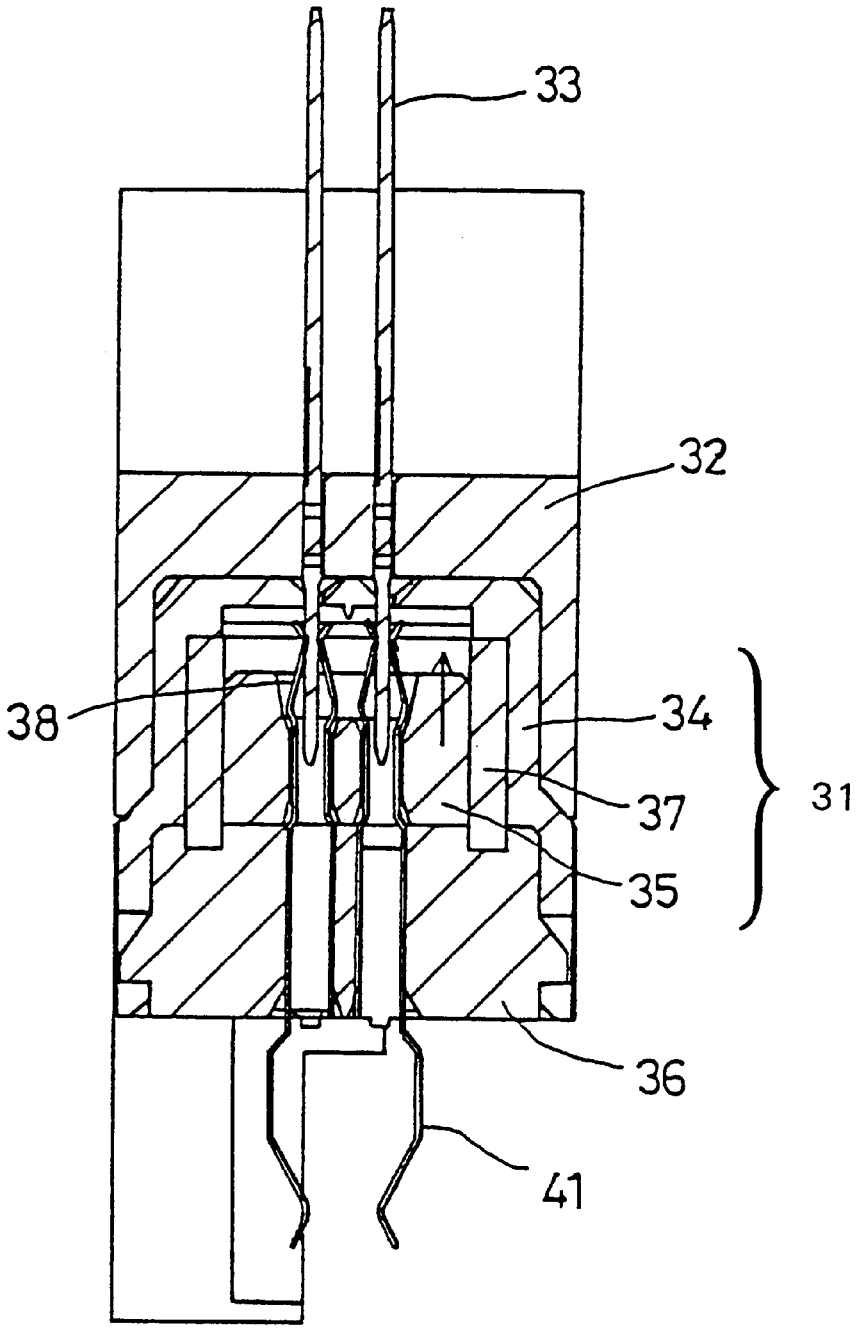
FIG. 12 is a diagram of a plug and a jack in a state of engagement.

FIG. 12 is a diagram of the above-described jack 31 and the above-described plug 32 in a state of engagement. This type of connector inserts the substrate between the leads 41 and is soldered to the substrate.

Figure 13:
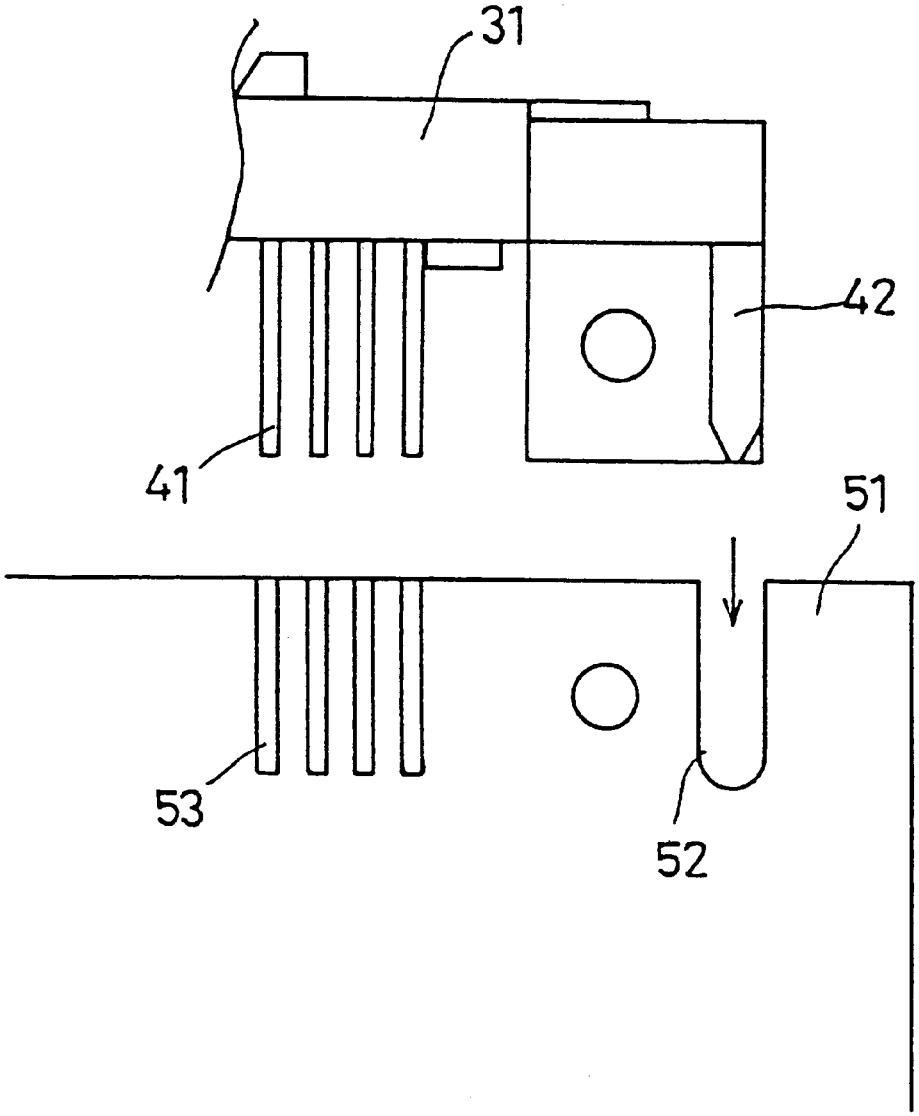
FIG. 13 shows a method of mounting on a substrate.

A detailed description will now be given of the present embodiment with reference to a method of mounting the connector of the present embodiment on the substrate as depicted in FIG. 13. As shown in FIG. 13, a projection 42 is provided on the base of the jack 31 for determining the position at which a slot 52 formed on the substrate 51 is to be engaged.

FIG. 14 shows the operation of the third embodiment of the present invention. The jack 31 of the present embodiment is mounted so as to engage projections 40 formed on the slide cam 37 with slanted slots 39 formed on both side surfaces of the actuator 35.

Figure 14B:
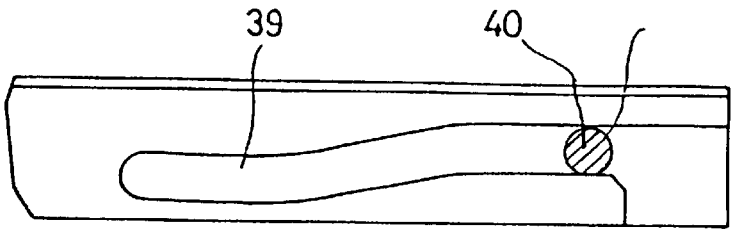
FIG. 14(A), FIG.14(B), FIG.14(C), FIG.14(D) are diagrams of the operation of a third embodiment of the present invention, specifically a strength of connection at its weakest, a position of a projection in that weakest state, a position of the projection with the strength of connection in its strongest state, and the strength of connection at its strongest.
Figure 14C:
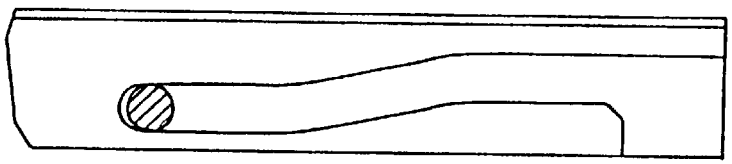
Figure 14A:
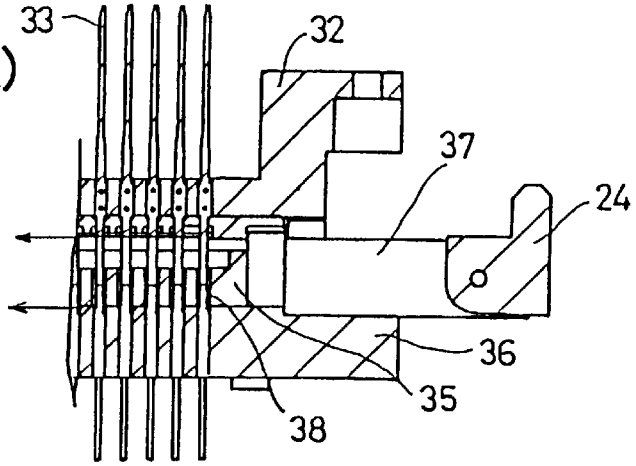

Initially, as shown in FIG. 14(A), the pins 33 of the plug 32 are inserted in the contacts 38 of the jack mounted on the substrate. At this stage the projection 40 on the slide cam 37 is accommodated at a predetermined initial position in the slot 39 on the actuator 35, as shown in FIG. 14(B). When the projection 40 is positioned at this initial position in the slot 39 the actuator is at a maximum low position, as shown in FIG. 14(A), and the contacts 38 of the jack 31 are in an open state. At this stage the strength of the connection between the contacts 38 and the pins 33 is at it weakest.

In the above-described state depicted in FIG. 14(B), gradually pushing the knob 24 of the slide cam 37 to the left, that is, in the direction of the arrow depicted in FIG. 8(B), simultaneously moves the projection 40 as well. The slot 39 is slanted, so as the projection 40 gradually moves leftward the actuator 35 is gradually lifted upward.

Figure 14D:
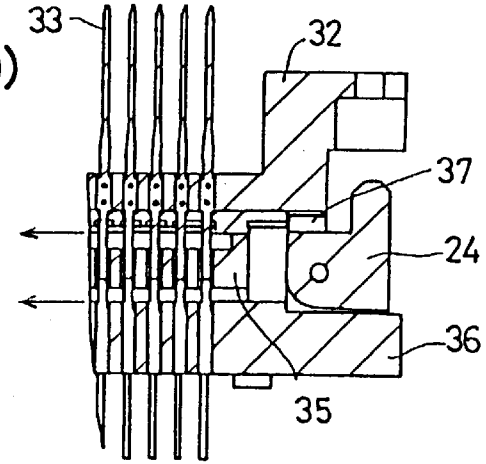

By continuing to push the knob 24 of the slide cam 37 leftward the projection 40 is moved to the position depicted in FIG. 14(C), the actuator 35 is positioned at a maximum high position as depicted in FIG. 14(D), the contacts 38 are squeezed by the actuator 35 and closed. At this stage the strength of the connection between the contacts 38 and the pins 33 is at its greatest.

As a result, by sliding the slide cam 37 horizontally the present embodiment adjusts the strength of the connection between the connectors 38 of the jack 31 and the pins 33 of the plug 32 by converting the horizontal movement of the slide cam 37 into the vertical movement of the actuator 35.

Additionally, as shown in FIG. 11 in the present embodiment a backslide prevention projection 43 is provided on the engaging portion of the jack 31 and a backslide prevention groove 44 is provided on the engaging portion of the plug 32. As a result, improper pin insertion can be prevented, thus eliminating the possibility of accidents or of damage to electrical components arising therefrom. It should be noted that the positions of the groove 21 and projections 22 may be reversed and that their quantity is arbitrary.

Figure 15:
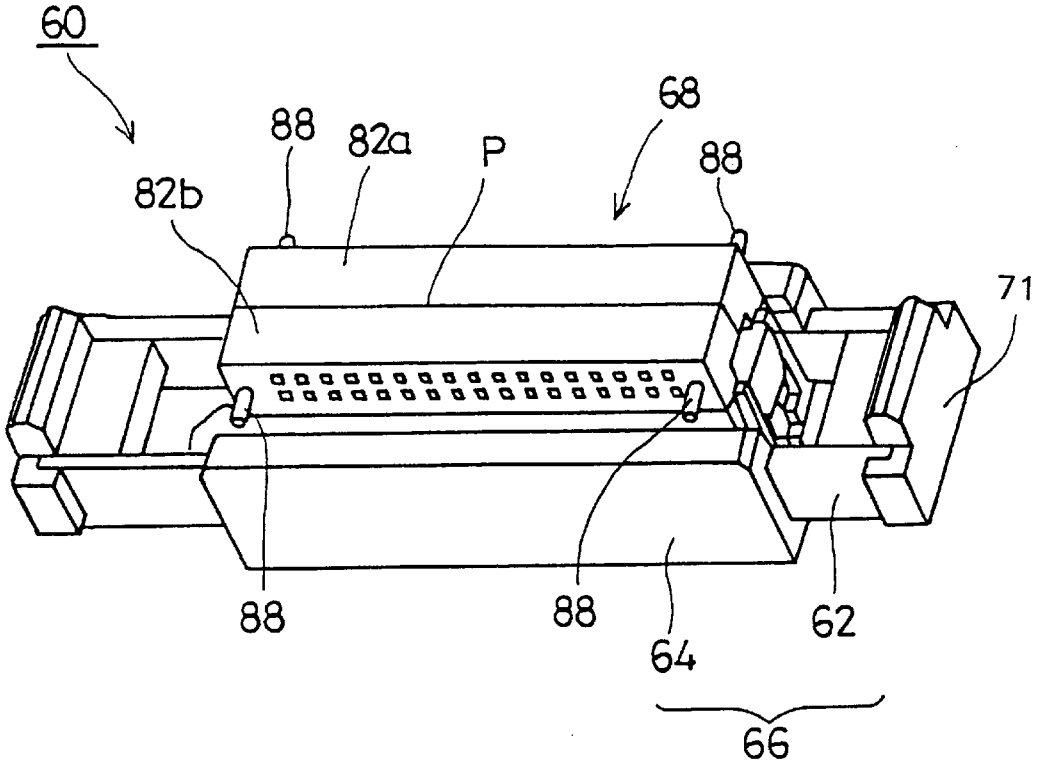
FIG. 15 is an oblique view of the connector of a fourth embodiment of the present invention.
Figure 16:
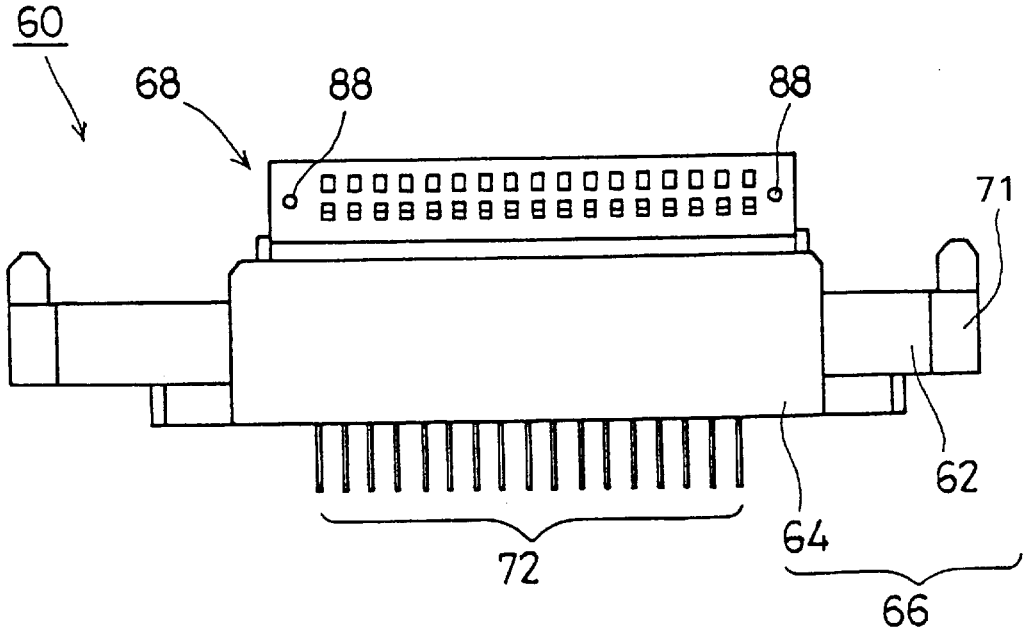
FIG. 16 is a front view of the connector of the fourth embodiment of the present invention.
Figure 17A:
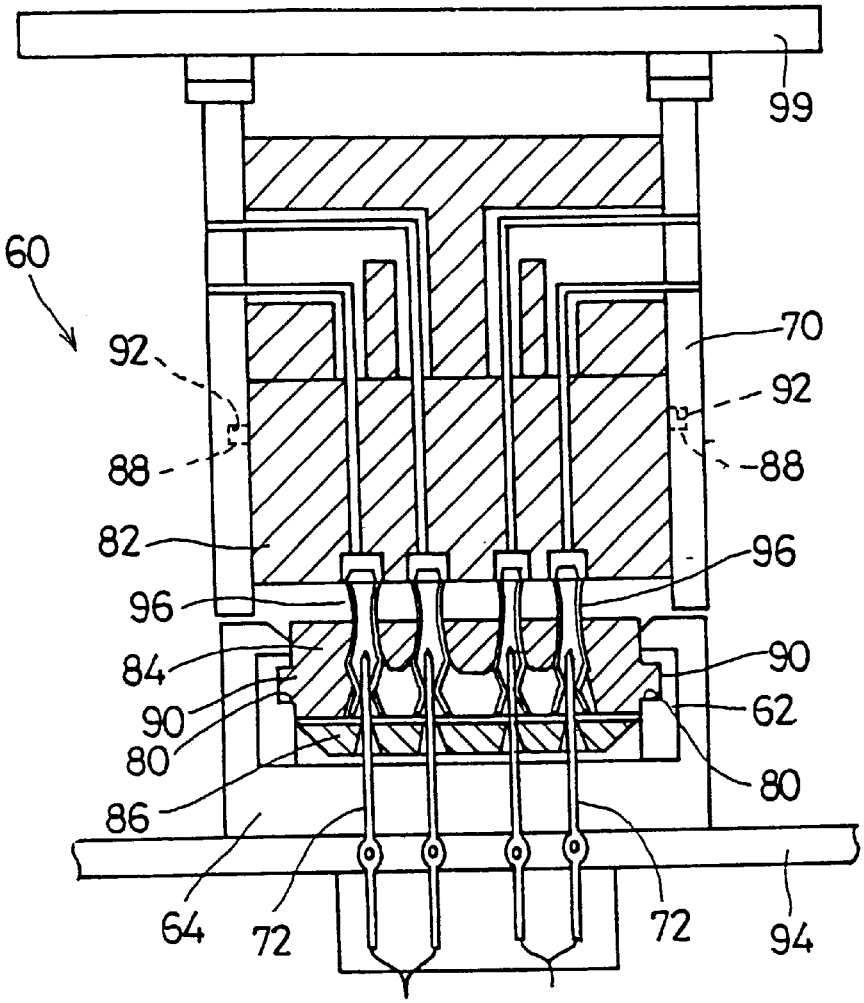
FIGS. 17(A) and 17(B) are a partial cross-sectional side view of the connector of the fourth embodiment of the present invention and a front view of a plug of the connector of the embodiment and a part of a substrate mounting the plug, respectively.
Figure 17B:
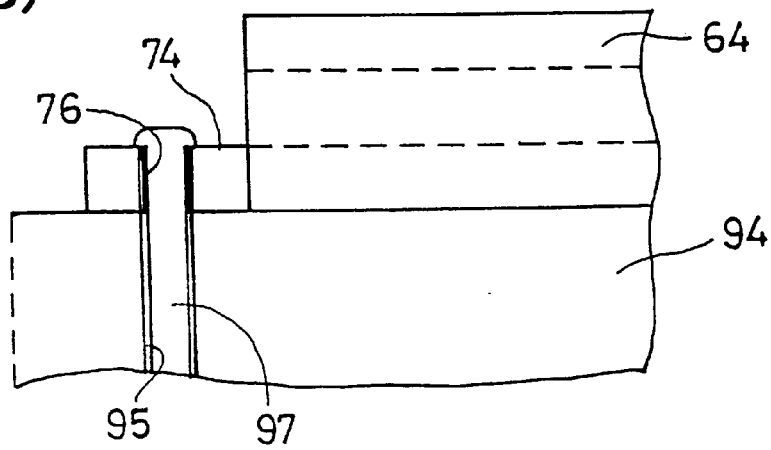
Figure 18:
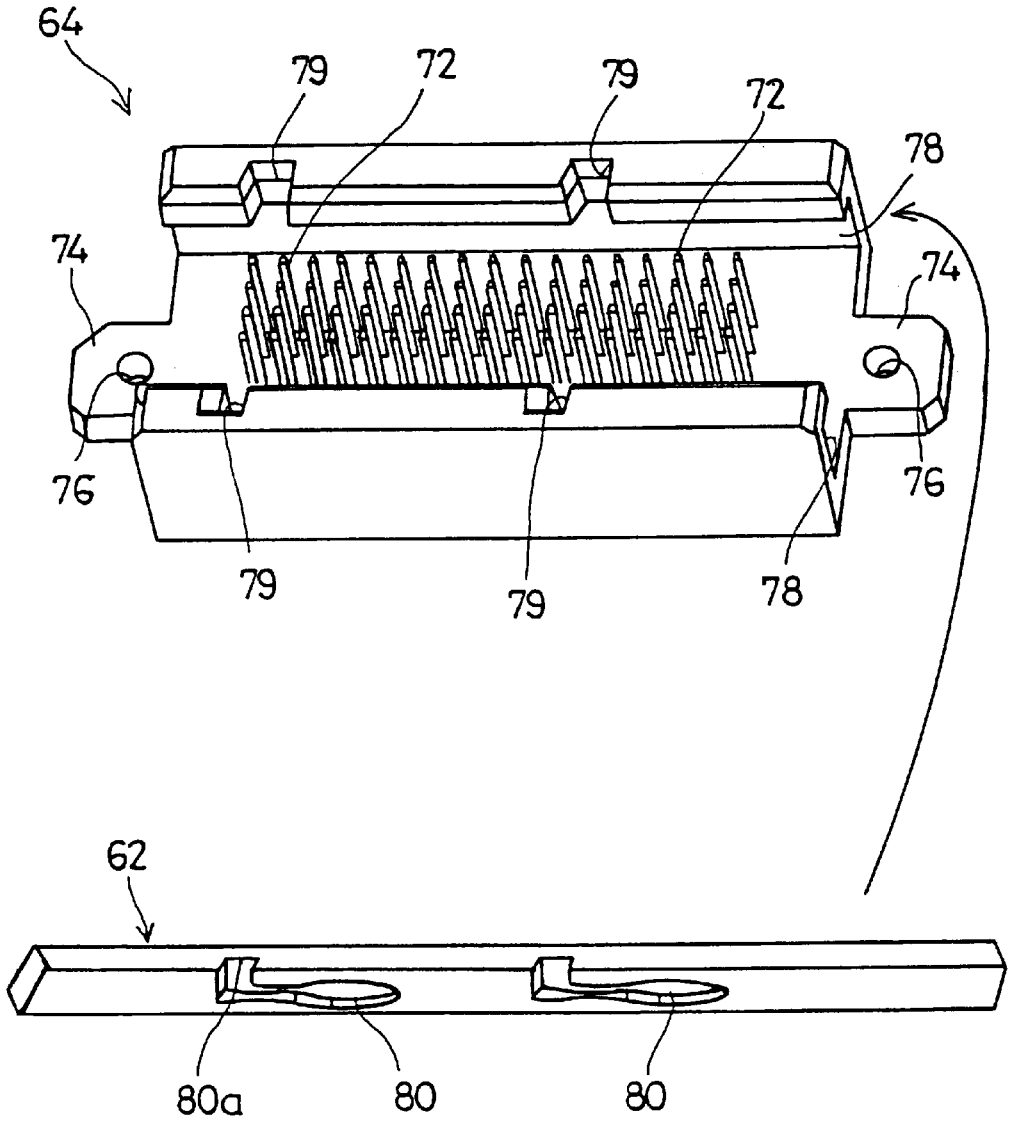
FIG. 18 is an expanded oblique view of the member comprising the main portion of the plug of the connector of the fourth embodiment of the present invention.
Figure 19:
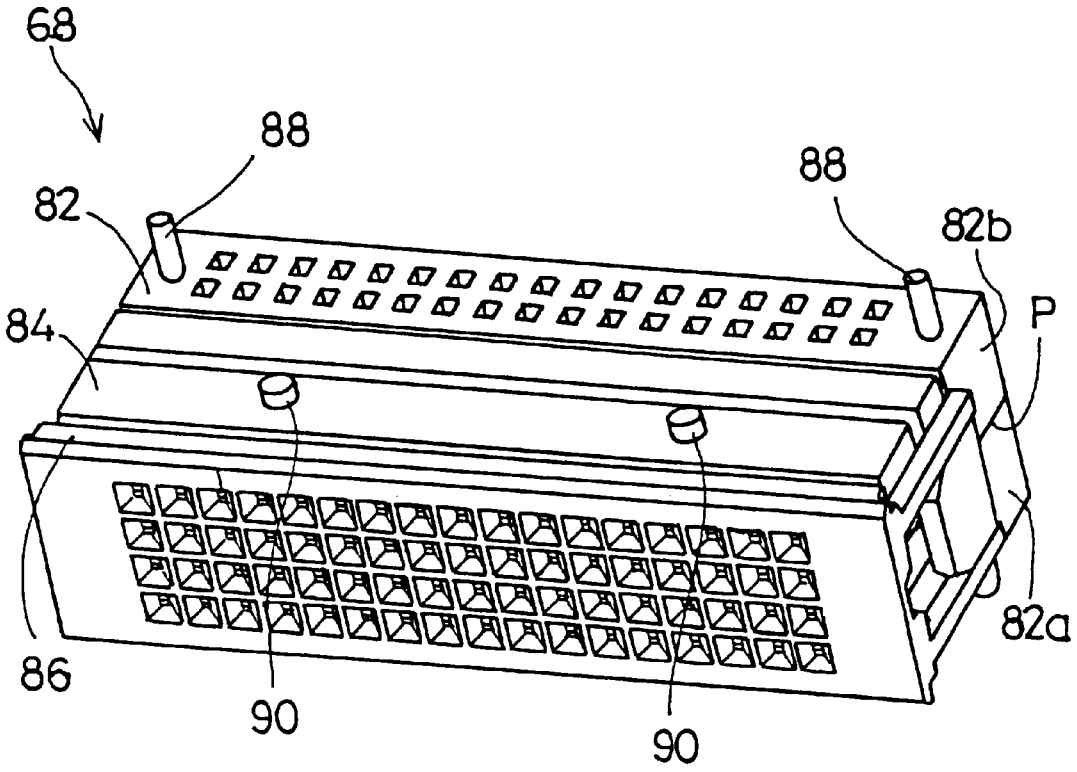
FIG. 19 is an oblique view of the jack of the connector of the fourth embodiment of the present invention.

FIGS. 15, 16, 17, 18 and 19 show a fourth embodiment of an LIF connecting structure according to the present invention. FIG. 15 shows an oblique view of the connector, FIG. 16 shows a front view of the connector, FIGS. 17(A) and 17(B) show a partial side cross-sectional view of the connector and a partial front cross-sectional view of the connector, respectively, FIG. 18 is an expanded oblique view of the member comprising the main portion of the plug of the connector and FIG. 19 is an oblique view of the jack of the connector.

As shown in FIGS. 15 and 16, the connector 60 of this fourth embodiment of the present invention comprises a slide cam 62 integrated into a single unit with the plug main unit 64 to form a plug 66, and a jack 68. Additionally, as shown in FIG. 17, a fixed substrate 70 is mounted on a side surface of the jack 68.

A detailed description will now be given of each of the aforementioned elements. As shown in FIG. 15, the plug has a plug main body 64 formed so as to have a U-shaped cross-section, a slide cam 62 mounted on the plug main body 64 and a slide cam mounting member 70 mounted on the slide cam 62.

On a bottom surface of the plug main unit 64 a plurality of pins 72 are inserted. At each of both ends of the longer longitudinal direction sides of this bottom surface there extends a projecting portion 74, on which an aperture portion 76, that is, a groove, is formed as shown in FIG. 17. Additionally, a groove portion 78 open toward the interior is formed in each of the two sides of the bottom surface of the plug main unit 64 extended in the longer longitudinal direction as shown in FIG. 18, and an opening portion 79 is formed on each of these two sides so as to communicate with the groove portion 78 and be open toward the top.

It should be noted that the slide cam 62 is a member having the shape of a regular rectangle, with two slots 80 formed thereon as shown in FIG. 18 instead of projections 23 and 40 provided on slide cams 17, 17*a* and 37 of the first, second and third embodiments, respectively. A notch portion 80*a* is provided on a tip portion of the slot 80 so as to accommodate a projection 90 on the jack 68 to be discussed later. The slide cam 62 is mounted in pairs within the groove portions 78 of the plug main body 64, positioned so that the surfaces on which the slots 80 are formed face each other. At the same time, the two ends of the slide cam 62 are fixedly mounted on the slide cam mounting members 70. The notched portion 80*a* is constructed so as to communicate with the opening portion 79.

On the jack 68 of the fourth embodiment there is mounted a jack base 82, an actuator 84 and a jack cover 86, as shown in FIG. 19. The jack base 82 is mounted so as to be divisible into two jack base members 82*a*, 82*b* at a dividing line P along a longer longitudinal direction of the jack base 82. A projection 88 for positioning and fixedly mounting the fixed substrate 70 having groove portions 92 at both ends is provided on an outer side surface of each of the two jack base members 82*a*, 82*b*, that is, on a side surface opposite the side surface along the dividing line P. Additionally, a projection 90 for engaging the slot 80 on the slide cam 62 is provided on both ends of each of two side surfaces of the actuator 84 extending in the longer longitudinal direction as shown in FIG. 17. Thus the fixed substrate 70 is mounted on the jack 68 by engaging the groove portion 92 of the fixed substrate 70 with the projection 88 of the jack 68 constructed as described above.

FIG. 17 shows a state in which the plug 66 and jack 68 are mounted on the substrate as described above and in which, further, the fixed substrate 70 is attached. Reference number 94 in FIG. 17 shows the substrate mounted on the plug 66. The plug main body 64 is fixedly mounted on the substrate 94 by a binding member 97 such as a pin or the like that is inserted into and through an aperture portion 95 formed in the substrate 94 and the aperture portion 76 formed in the plug main body 64. Additionally, reference number 72 in FIG. 17 indicates the pin used to attach the substrate 94 to the plug 66 and reference number 96 indicates the contact mounted on the jack. Additionally, reference number 99 indicates yet another substrate connected to an edge portion of the fixed substrate 70.

As shown in FIG. 17, the actuator 84 is separated from a base portion 82 and positioned adjacent to the plug main body 64, with the contacts 96 engaged with the pins 72 in great strength.

A description will now be given of a method for mounting the plug 66 on the jack 68 in a connector 60 configured as described above.

The plug 66 is previously fixedly mounted on the substrate 82 by pins 72. At the same time, contacts 96 are mounted on the jack 68. In FIG. 17, the plug 66 is positioned so that the tips of the pins 72 thereof to be inserted are disposed upward and the jack cover 86 is positioned so as to be disposed downward in such a way that the jack 68 is mounted on the plug 66 from above. As a result, the projection 90 of the jack 68 is inserted into the slot 80 from the notched portion 80*a* of the slot 80 of the plug main body 64 via the opening portion 79 and engaged. At this stage the pins 72 and the contacts 96 are in a state just prior to engagement. The slide cam 62 on which the slot 80 is provided is moved in a direction perpendicular to the surface of the paper on which the diagram is drawn, thus lowering the projections 90 along the slant of the slot 80, gradually bringing the actuator into contact with the bottom portion of the plug main body 64. As a result, the strength of the contact between the pins 72 and the contacts 96 increases. The effect of this mechanism is essentially the same as that of the first embodiment depicted in FIG. 8 and the second embodiment depicted in FIG. 14, so a detailed discussion thereof is omitted.

According to this fourth embodiment of the present invention, the horizontal movement of the integrated member integrated into a single unit with the plug 66, that is, the slide cam 62, makes it possible to provide an LIF connector that does not require a tool. As a result, it is possible to reduce the load surface area on the substrate 94 and, further, eliminate the need for space on the substrate 94 for insertion and removal, thus making it possible to achieve advantages like those provided by the first and third embodiments of the present invention. Additionally, in the fourth embodiment the jack cover has been lightened, making it possible to reduce the costs of raw materials. Additionally, it is possible to stack and mount a further substrate 99 via the fixed substrate 70 mounted on the base portion 82.

Figure 20:
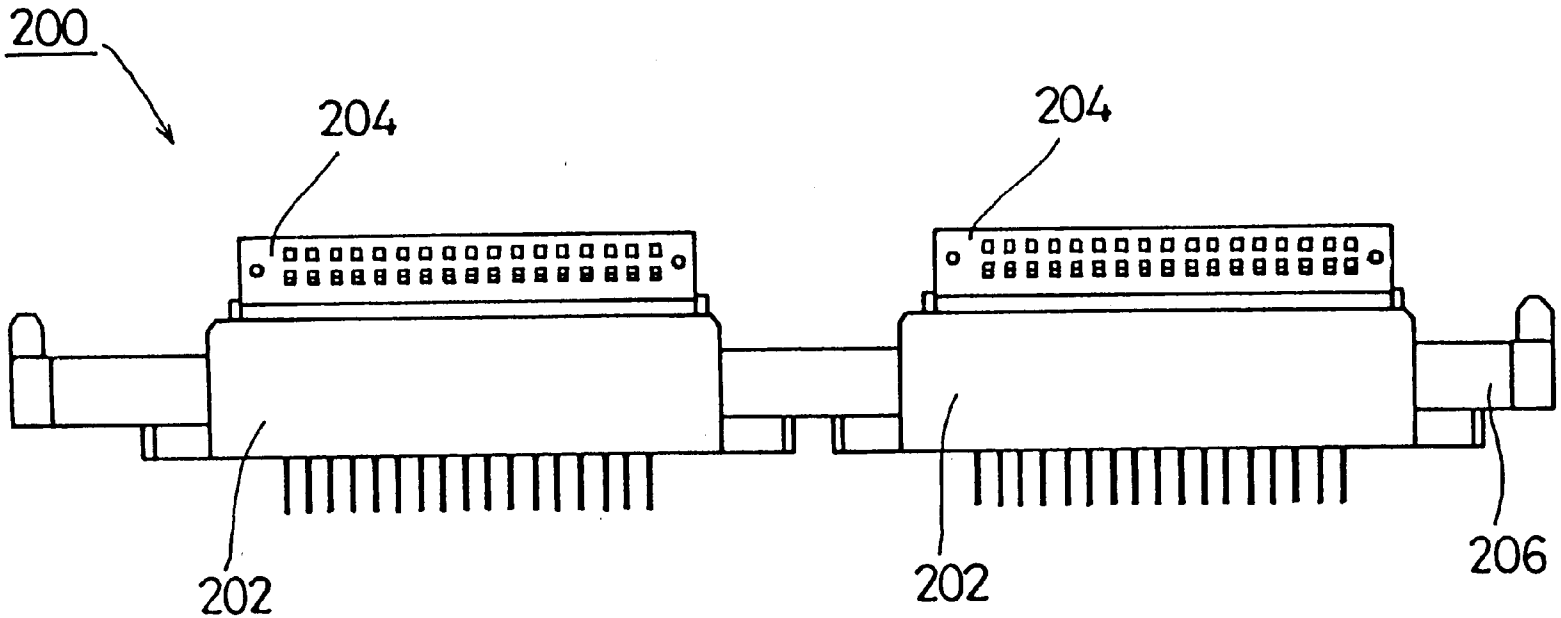
FIG. 20 is a front view of the connector of a fifth embodiment of the present invention.

FIG. 20 shows a side view of a fifth embodiment of the connector 200, which has structural elements virtually identical to the fourth embodiment as described above, comprising a plug main body 202 and a jack 204. Although not shown in the diagram, this fifth embodiment, like the fourth embodiment, is constructed so that the projections of each jack 204 engage slots in the slide cams 206 mounted on the plug main bodies 202. Accordingly, the up and down movement of the actuators of a plurality of jacks 204 is accomplished by the horizontal movement of a single slide cam mounting member mounting a slide cam.

According to this fifth embodiment of the present invention, the adjustment of the strength of the connections between the plurality of jacks 204 and plugs 202 can be carried out by using the single slide cam 206.

Figure 21:
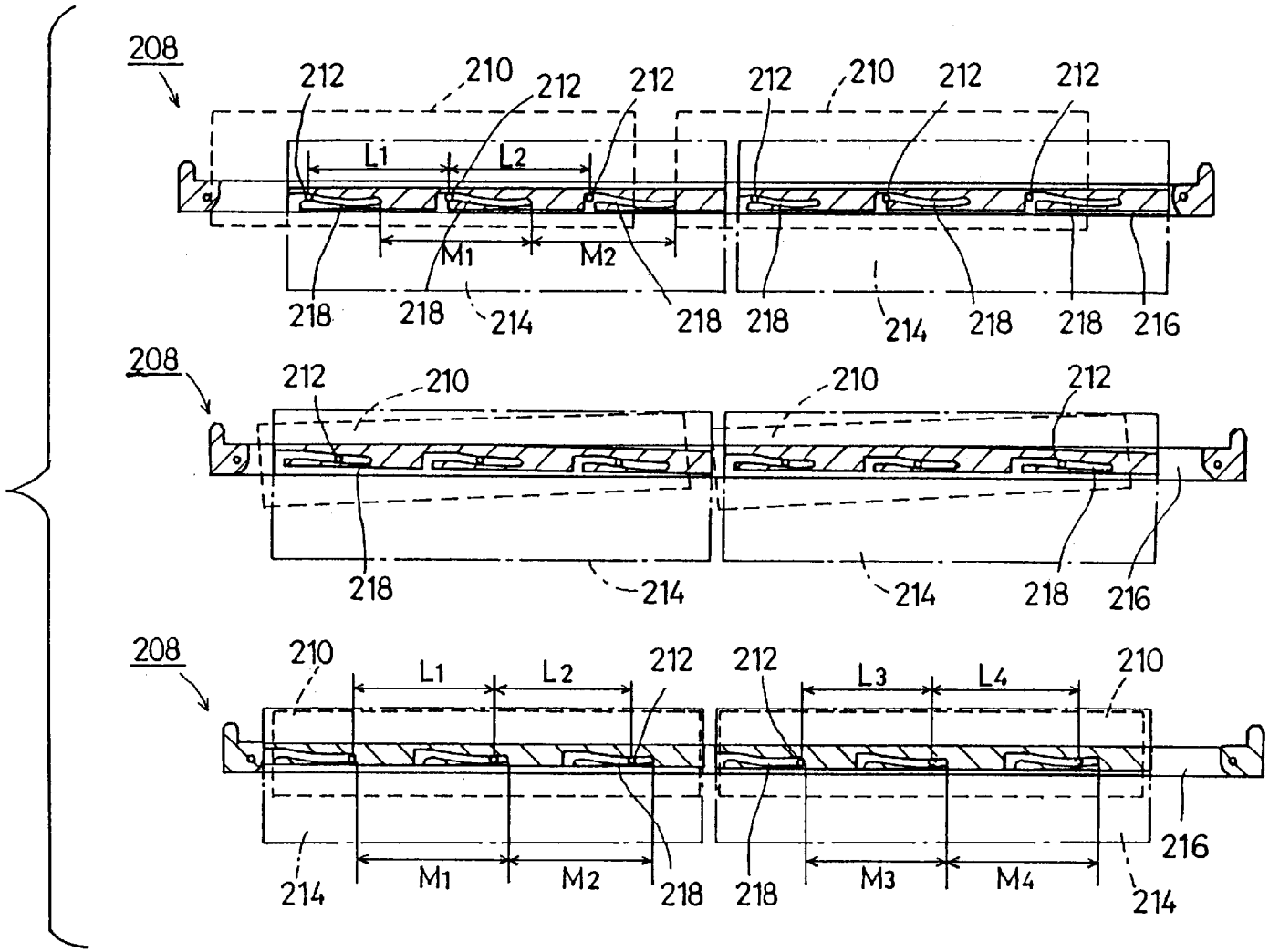
FIG. 21 is a partial front view of the connector of a sixth embodiment of the present invention.

FIG. 21 is a partial front view of the connector of a sixth embodiment of the present invention. The structural elements of this sixth embodiment are virtually identical to those of the fifth embodiment described above and depicted in FIG. 20. Accordingly, a projection 212 on two actuators 210 provided on each jack engage a slot 218 of the slide cam 216 of the plug main unit 214. It should be noted that contacts inserted in the actuator 210 of the jack and the pins of the plug for engaging the contacts of the jack are omitted from the diagram.

Additionally, although not explained with respect to the fifth embodiment described above, in order to adjust the strength of the connection between the jack 204 and the plug 202 the plurality of projections 90 and slots 80 depicted are disposed at an identical pitch. That is, the spacing between the projections 90 and the spacing between the slots 80 is identical within each of the plurality of jack-plug structural units. By contrast, in the sixth embodiment the pitch L1, L2 of the projections 212 and the pitch M1, M2 of the slots 218 are not identical. That is, although the pitch L1, L2 of the projections 212 is even within a single jack-plug structural unit the pitch M1, M2 of the slots is not even between such structural units but gradually increases toward the left in FIG. 21, that is, M2 is greater than M1. It should be noted that between each jack-plug structural unit the relationship of the pitch is even, that is, L1=L3, L2=L4, M1=M3, M2=M4.

A description will now be given of the effect of the connector 208 of the above-described sixth embodiment. In FIG. 21, (a) depicts a state just prior to engagement of the contacts and the pins, that is, a state in which the actuator 210 is at a maximum distance from the plug main body 214. When in the state shown in (a) the plug main body 214 slide cam 216 is moved horizontally toward the right in FIG. 21 in a state shown in (b), the projections 212 move within the slanted slot 218 and the actuator 210 moves downward. At this stage the pitch L1, L2 of the projections 212 is even whereas the pitch M1, M2 of the slots 218 is not, with the pitch gradually increasing toward the right. As a result, as the projections 212 move within the slots 218 toward the right the rate at which the projections 218 advance slows. That is, when the left edge portion of the actuator 210 reaches the bottom of the lower plug main body 214 the movement of the right edge portion downward slows and, as is shown in FIG. 21, the left edge portion is in a lower tilted position. In this condition, the contact-pin engagement of the actuator 210 left end portion proceeds to strengthen but the right end portion contact-pin engagement lags and the strength of connection is weak. Accordingly, the force required to move the plug main body 214 slide cam 216 to the right is dispersed temporally and the slide cam 216 can therefore be moved with a minimal force. Accordingly, as shown in (c), by moving the plug main body 214 slide cam 216 further to the right the projection 212 on the right end portion slides through the slanted portion of the slot 218 to the lower left. Accordingly, the whole of the contacts and pins engage in strength.

It should be noted that so long as each of the individual jack-plug structural units is configured so as to behave like the sixth embodiment described above it is not necessary to make the relationship between the pitches between the individual jack-plug structural units uniform. Additionally, though not depicted in the diagram the structure of the arrangement of the projection and slot of the sixth embodiment described above is likewise applicable to the connectors of the first through fourth embodiments as well, with the same effects and advantages achieved as with the sixth embodiment.

The above description is provided in order to enable any person skilled in the art to make and use the invention and sets forth the best mode contemplated by the inventors of carrying out their invention.

The present invention is not limited to the specifically disclosed embodiments and variations, and modifications may be made without departing from the scope of the present invention.

The present application is based on Japanese priority applications Nos. 10-160634 and 11-98137, both filed on Jun. 9, 1998, the entire contents of which are hereby incorporated by reference.

What is claimed is:

1. A connector comprising:

an actuator to adjust a strength of contact between contacts of a jack and pins of a plug, the actuator moving vertically within the jack; and an integrated member integrated into a single unit with the jack and sandwiched between the jack and the plug when the jack and the plug are joined together so that the integrated member slidably contacts both the jack and the plug, the integrated member moving horizontally between the jack and the plug, wherein the horizontal movement of the integrated member is converted into the vertical movement of the actuator to adjust a strength of a contact between the contacts of the jack and the pins of the plug in the absence of a tool to move the integrated member horizontally and thereby move the actuator vertically.

2. The connector as claimed in claim 1, wherein the actuator comprises slanted slots on opposing surfaces of the actuator and the integrated member comprises projections which engage the slanted slots provided on the opposing side surfaces of the actuator, and the integrated member slides horizontally along the slanted slot to convert the horizontal movement of the integrated member into the vertical movement of the actuator.

3. The connector as claimed in claim 2, wherein the integrated member is formed so as to be linked within a plurality of jacks, and the integrated member slides horizontally along the slanted slot to convert the horizontal movement of the integrated member into the vertical movement of a plurality of actuators.

4. The connector as claimed in claim 1, wherein one of either a jack engaging portion or a plug engaging portion comprises a projection to prevent backsliding and the other of either the jack engaging portion or the plug engaging portion comprises a groove to prevent backsliding.

5. The connector as claimed in claim 1, further comprising a substrate, pins formed on an upper surface of the substrate, and aperture portions formed on a lower surface of the jack, wherein the pins are inserted into the aperture portions to mount the jack on the substrate.

6. The connector as claimed in claim 1, further comprising a substrate having a groove formed therein, and wherein the jack comprises a base portion including a position-determining projection that fits into the groove formed in the substrate.

7. The connector as claimed in claim 2, wherein the slots are disposed at a pitch gradually greater than that of the projections.

8. A connector comprising:

an actuator to adjust a strength of contact between contacts of a jack and pins of a plug, the actuator moving vertically within the jack; and an integrated member integrated into a single unit with the plug and sandwiched between the jack and the plug when the jack and the plug are joined together so that the integrated member slidably contacts both the jack and the plug, the integrated member moving horizontally between the jack and the plug, wherein the horizontal movement of the integrated member is converted into the vertical movement of the actuator to adjust a strength of the contact between the contacts of the jack and the pins of the plug in the absence of a tool to move the integrated member horizontally and thereby move the actuator vertically.

9. The connector as claimed in claim 8, wherein the integrated member comprises slanted slots on opposing side surfaces and the actuator comprises projections which engage the slanted slots on the opposing side surfaces of the integrated member, and the integrated member slides horizontally along the slanted slot to convert the horizontal movement of the member into the vertical movement of the actuator.

10. The connector as claimed in claim 8, wherein the integrated member is formed so as to be linked within a plurality of jacks, and the integrated member slides horizontally to convert the movement of the integrated member into the vertical movement of the actuator.

11. The connector as claimed in claim 8, further comprising a fixedly mounted substrate on a side surface along a longer longitudinal direction of the jack.

12. The connector as claimed in claim 8, further comprising a substrate including an aperture portion, wherein the plug includes an aperture portion engaging an engaging member penetrating the aperture portion of the substrate to position and fixedly mount the substrate.

13. The connector as claimed in claim 8, further comprising a substrate having an aperture portion formed therein, and wherein the jack comprises a base including a projection integrally formed on a lower surface of the jack base to engage the aperture portion of the substrate to position and fixedly mount the substrate.

14. The connector as claimed in claim 8, wherein the projections are disposed at a uniform pitch and the slots are disposed at a pitch gradually greater than that of the projections.

15. A connector comprising:

an actuator to adjust a strength of contact between contacts of a jack and pins of a plug, the actuator moving vertically within the jack; and an integrated member integrated into a single unit with the jack and sandwiched between the jack and the plug when the jack and the plug are joined together, the integrated member slidably contacting both the jack and the plug and moving horizontally between the jack and the plug, wherein the horizontal movement of the integrated member is converted into the vertical movement of the actuator to adjust a strength of a contact between the contacts of the jack and the pins of the plug.

16. A connector comprising:

an actuator to adjust a strength of contact between contacts of a jack and pins of a plug, the actuator moving vertically within the jack; and an integrated member integrated into a single unit with the plug and sandwiched between the jack and the plug when the jack and the plug are joined together, the integrated member slidably contacting both the jack and the plug and moving horizontally between the jack and the plug, wherein the horizontal movement of the integrated member is converted into the vertical movement of the actuator to adjust a strength of the contact between the contacts of the jack and the pins of the plug.

* * * * *